US008256097B2

(12) United States Patent
Yoshimori

(10) Patent No.: US 8,256,097 B2
(45) Date of Patent: Sep. 4, 2012

(54) METHOD FOR MANUFACTURING A COIL DEVICE

(75) Inventor: Hitoshi Yoshimori, Izumisano (JP)

(73) Assignee: SHT Corporation Limited, Izumisano-shi, Osaka (JP)

( * ) Notice: Subject to any disclaimer, the term of this patent is extended or adjusted under 35 U.S.C. 154(b) by 268 days.

(21) Appl. No.: 12/681,080

(22) PCT Filed: Sep. 26, 2008

(86) PCT No.: PCT/JP2008/067453

§ 371 (c)(1),
(2), (4) Date: Mar. 31, 2010

(87) PCT Pub. No.: WO2009/044676

PCT Pub. Date: Apr. 9, 2009

(65) Prior Publication Data

US 2010/0218366 A1 Sep. 2, 2010

(30) Foreign Application Priority Data

Oct. 2, 2007 (JP) ..... 2007-258394

(51) Int. Cl.
*H01F 7/06* (2006.01)

(52) U.S. Cl. ..... 29/605; 29/602.1; 29/604; 29/606; 336/65; 336/83; 336/90

(58) Field of Classification Search ..... 29/592.1, 29/602.1, 604–606; 336/65, 83, 90–96, 200, 336/206–208

See application file for complete search history.

(56) References Cited

U.S. PATENT DOCUMENTS

| | | | | |
|---|---|---|---|---|
| 4,057,283 | A * | 11/1977 | Barnett | 296/173 |
| 4,730,777 | A * | 3/1988 | Graul et al. | 242/434.5 |
| 6,218,773 | B1 * | 4/2001 | Misono et al. | 313/440 |
| 7,498,916 | B2 * | 3/2009 | Feist et al. | 336/65 |
| 2005/0001709 | A1 | 1/2005 | Pais et al. | |

FOREIGN PATENT DOCUMENTS

EP 0178851 A2 4/1986

(Continued)

OTHER PUBLICATIONS

International Search Report of PCT/JP2008/067453, mailing date of Dec. 16, 2008. Supplementary European Search Report dated Mar. 20, 2012, issued in corresponding European Patent Application No. 08836662.0.

*Primary Examiner* — Paul D Kim
(74) *Attorney, Agent, or Firm* — Westerman, Hattori, Daniels & Adrian, LLP

(57) ABSTRACT

A method for manufacturing a coil device comprises a first step of twisting a tip end part of the conductive wire by approximately 90 degrees with respect to a conductive wire portion arranged rearward continuously from the tip end part to form a twist part, and winding the tip end part of the conductive wire around the outer peripheral surface of the core in a lying posture on the outer peripheral surface; a second step of winding the conductive wire arranged rearward continuously from the twist part around the outer periphery surface of the core in a standing posture on the outer peripheral surface; and a third step of transforming the conductive wire on a tip end side with respect to the twist part in a direction apart from the outer periphery surface of the core to form one lead part extending substantially linearly.

7 Claims, 17 Drawing Sheets

FOREIGN PATENT DOCUMENTS

| | | | |
|---|---|---|---|
| JP | 7-45464 | A | 2/1995 |
| JP | 2001-052917 | A | 2/2001 |
| JP | 2001-85233 | A | 3/2001 |
| JP | 2001-196233 | A | 7/2001 |
| JP | 2004-158653 | A | 6/2004 |
| JP | 2004-273518 | A | 9/2004 |
| JP | 2004-311851 | A | 11/2004 |
| JP | 2004-327461 | A | 11/2004 |
| JP | 2005-93852 | A | 4/2005 |

* cited by examiner

METHOD FOR MANUFACTURING A COIL DEVICE

TECHNICAL FIELD

The present invention relates to a coil device formed by winding a coil around a ring-like core such as a toroidal coil device and a method for manufacturing the coil device.

BACKGROUND ART

Conventionally, as a method for manufacturing a toroidal coil device employing a rectangular wire as a coil conductive wire, there has been proposed a method of, first, winding a conductive wire A around a round-shaft-like core B to form it in a shape of a coil as shown in FIG. 26(*a*), and thereafter, extracting the core B to make it an air core coil C as shown in FIG. 26(*b*), then subsequently, winding the air core coil C around a ring-like core D while transforming one end part of the air core coil C as shown in FIG. 26(*c*).

However, in the manufacturing method shown in FIG. 26, a rotational drive mechanism to wind the air core coil C around the ring-like core D as shown in FIG. 26(*c*) is complicated, and moreover, if transformation of the one end of the air core coil C exceeds an elastic deformation limit, subsequent winding step becomes extremely difficult.

Therefore, a manufacturing apparatus shown in FIGS. 23 and 24 is proposed (Japan Patent Laid-Open 2004-327461). This manufacturing apparatus includes a guide member 9 through which a conductive wire 21 passes, a pair of drive rollers 91, 91 which feed the conductive wire 21 in the guide member 9, and a forming member 7 for bending the conductive wire 21 fed from the guide member 9. By feeding the conductive wire 21 from the guide member 9, and at the same time pressing the conductive wire 21 against a forming surface 71 of the forming member 7, the apparatus bends the conductive wire 21 as indicated by a chain line in FIG. 25, and winds the conductive wire 21 around an outer peripheral surface of a core 1 as shown in FIGS. 23 and 24.

DISCLOSURE OF THE INVENTION

Problems to be Solved by the Invention

In the manufacturing method of the coil device using the manufacturing apparatus shown in FIGS. 23 and 24, after winding the conductive wire 21 around the outer peripheral surface of the core 1 to form a winding portion 22 as shown in FIG. 23, it is necessary to deform plastically a tip end part 23 of the winding portion 22 in a direction apart from the outer peripheral surface of the core 1 to form into a substantially linear shape as indicated by a chain line in FIG. 23 in order to form a lead part for connection with a substrate.

However, the conductive wire 21 with a rectangular cross-section which forms the winding portion 22 has greatly different two second moments of area about two axes perpendicular to each other, and the conductive wire 21 is wound in a standing posture on the outer peripheral surface of the core 1. Therefore, the larger second moment of area of the conductive wire 21 participates in the transformation in the direction apart from the outer peripheral surface of the core 1. Therefore, in order to transform the conductive wire 21 in the direction apart from the outer peripheral surface of the core 1, a special tool is required and a great force is required, making the formation of the lead part extremely difficult.

For this reason, at present, the manufacturing apparatus shown in FIGS. 23 and 24 has not been in practical use.

An object of the present invention is, in a coil device employing a conductive wire which has a cross-sectional shape with a height dimension greater than a width dimension to form a coil, to provide a structure of the coil device in which a lead part can be formed easily, and a manufacturing method of the coil device.

Means for Solving the Problem

A coil device according to the present invention comprises a ring-like core 1 with a coil 2 wound therearound, the coil 2 includes a winding portion 22 formed by a conductive wire 21 wound around the core 1, and a pair of lead parts 4, 5 formed by the conductive wire 21 projecting from both ends of the winding portion 22. The conductive wire 21 has a cross-sectional shape with a height dimension H greater than a width dimension W, and the conductive wire 21 forming the winding portion 22 is aligned in a widthwise direction of the conductive wire 21 along an outer peripheral surface of the core 1 and repeatedly wound. Between at least either of the lead parts 4 and the winding portion 22, formed is a twist part 3 where the conductive wire 21 is twisted by 90 degrees or approximately 90 degrees.

A manufacturing method of the coil device described above comprises:

a first step of forming a twist part 3 where a tip end part of the conductive wire 21 is twisted 90 degrees or approximately 90 degrees with respect to a conductive wire portion arranged rearward continuously from the tip end part, and winding the tip end part of the conductive wire 21 around the outer peripheral surface of the core 1 in a lying posture on the peripheral surface;

a second step of winding the conductive wire 21 arranged rearward continuously from the twist part 3 around the outer periphery surface of the core 1 in a standing posture on the outer peripheral surface to form the winding portion 22; and a third step of transforming the conductive wire 21 on a tip end side with respect to the twist part 3 in a direction apart from the outer periphery surface of the core 1 to form one lead part 4 extending substantially linearly, and forming the other lead part 5 by the conductive wire 21 arranged rearward continuously from the winding portion 22.

According to the manufacturing method of the coil device described above, in the third step, when separating the conductive wire 21 on the tip end side with respect to the twist part 3 which is wound around the core 1 from the outer periphery surface of the core 1 to form it into a linear shape, since the conductive wire 21 on the tip end side is wound around the outer periphery surface of the core 1 in a lying posture on the outer peripheral surface, the smaller second moment of area of the conductive wire 21 participates in the transformation in the direction apart from the outer periphery surface of the core 1. Therefore, a great force is not necessary to transform the conductive wire 21 in the direction apart from the outer peripheral surface of the core 1, and the lead part can be formed easily.

In a particular embodiment, the first step comprises:

a twist part forming step of twisting the tip end part of the conductive wire 21 by 90 degrees or approximately 90 degrees with respect to the conductive wire 21 arranged rearward continuously from the tip end part to form a twist part 3 on the conductive wire 21; and a conductive wire winding step of thereafter winding the conductive wire 21 on the tip end side with respect to the twist part 3 around the outer periphery surface of the core 1 in a lying posture on the outer peripheral surface.

In a further particular embodiment, in the twist part forming step, the tip end part of the conductive wire 21 is bent in such a direction and at such a curvature that the tip end part can be wound in a standing posture on the outer peripheral surface of the core 1, and thereafter, the twist part 3 is formed on the tip end side of a bent portion. And in the conductive wire winding step, the conductive wire 21 on the tip end side with respect to the twist part 3 is placed so as to follow the outer peripheral surface of the core 1.

Also, in the twist part forming step, after forming the twist part 3 on the tip end part of the conductive wire 21, the conductive wire 21 on the tip end side with respect to the twist part 3 is bent in such a direction that the conductive wire 21 follows the outer peripheral surface of the core 1.

The conductive wire 21 has a cross-sectional shape with different second moments of area in directions perpendicular to each other. In the first step, the conductive wire 21 on the tip end side with respect to the twist part 3 is bent in a direction where the second moment of area is smaller to be wound around the outer peripheral surface of the core 1. And in the second step, the conductive wire 21 arranged rearward continuously from the twist part 3 is bent in a direction where the second moment of area is greater to be wound around the outer peripheral surface of the core 1.

In a further particular embodiment, in the second step, the conductive wire 21 is fed toward a forming member, the core 1 placed on a plane crossing a direction in which the conductive wire 21 is fed is rotated around a central axis of the core 1, and the conductive wire 21 is pressed against a forming surface of the forming member, to bend the conductive wire 21 and wind the conductive wire 21 around the outer peripheral surface of the core 1.

Effect of the Invention

According to the present invention, in a manufacturing method of a coil device which employs a conductive wire having a cross-sectional shape with a height dimension greater than a width dimension to form a coil, by employing a simple step of only winding the conductive wire around an outer peripheral surface of a core with a tip end part of the conductive wire to be one lead part twisted, subsequent formation of the lead part can be performed easily.

EXPLANATION OF REFERENCE NUMERALS

Figure 1:
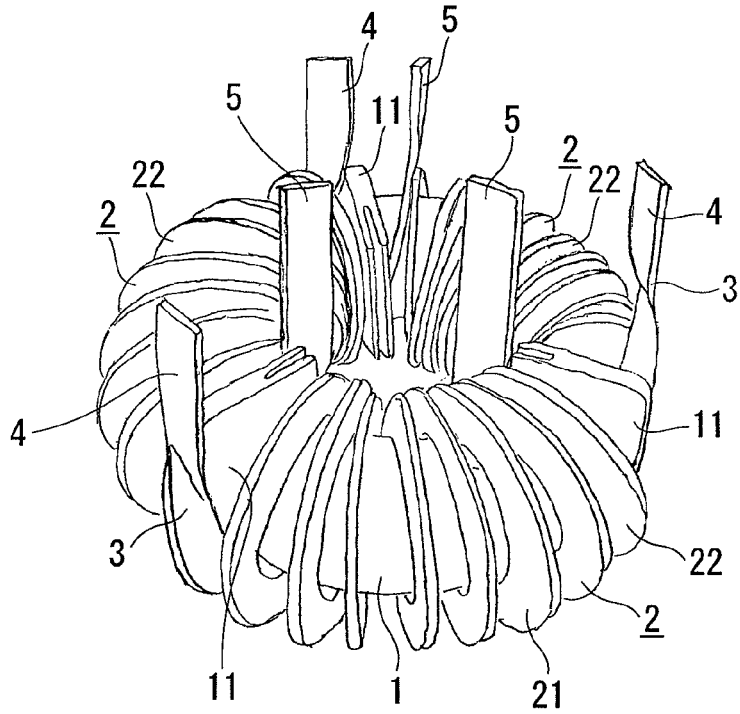
FIG. 1 is a perspective view of a coil device according to the present invention.

1 core
11 rib
2 coil
21 conductive wire
22 winding portion
3 twist part
4 lead part
5 lead part
100 conductive wire feeding device
110 forming device
120 tip end part forming device
130 core holding device
140 conductive wire folding mechanism

BEST MODE FOR CARRYING OUT THE INVENTION

An embodiment of the present invention is to be described in detail below with reference to the drawings.

A coil device according to the present invention comprises a ring-like core 1 and three coils 2, 2, 2 wound around the core 1 as shown in FIG. 1. A three-phase alternating current is supplied to the three coils 2, 2, 2.

Specifically, the core 1 comprises a ring-like magnetic core covered by a covering layer made of synthetic resin, and three ribs 11, 11, 11 project with a phase difference of 120 degrees on an outer peripheral surface of the core 1. Three winding areas are thereby formed, and a coil 2 is wound in each winding area.

Each coil 2 includes a winding portion 22 formed by a conductive wire 21 wound around the core 1, and a pair of lead parts 4, 5 formed by the conductive wire 21 projecting from both ends of the winding portion 22.

Figure 2:
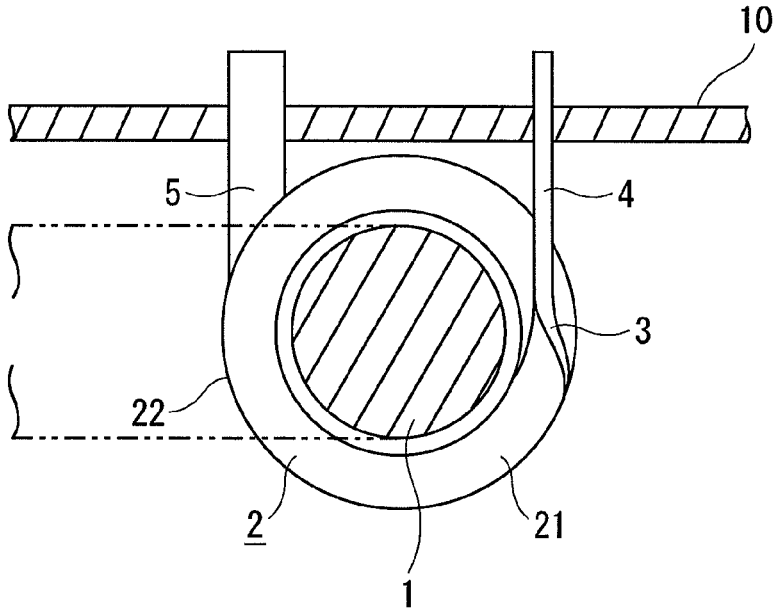
FIG. 2 is a cross-sectional view showing an essential part in a state where the coil device is mounted on a substrate.

In the coil device shown in FIG. 1, tip end parts of the lead parts 4, 5 of each coil 2 passes through a substrate 10 as shown in FIG. 2, and the coil device is mounted on the substrate 10.

Figure 22A:
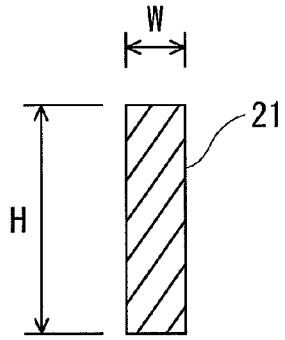
FIG. 22 is a view showing cross-sectional shapes of various conductive wires.
Figure 22B:
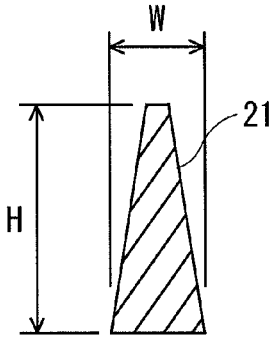
Figure 22C:
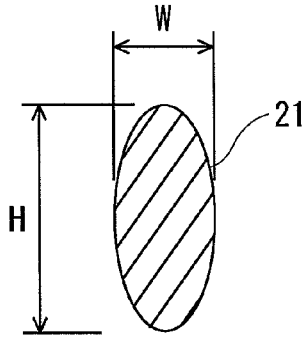

Here, the conductive wire 21 forming each coil 2 is a rectangular wire having a rectangular cross-section as shown in FIG. 22(*a*). A height dimension H of the cross-section is greater than a width dimension W thereof, and there is a great difference between two second moments of area in directions perpendicular to each other.

The conductive wire 21 forming each coil 2 is aligned along the outer peripheral surface of the core 1 in a widthwise direction of the conductive wire 21 as shown in FIG. 1, and is repeatedly wound.

As shown in FIG. 1, a twist part 3 where the conductive wire 21 is twisted by 90 degrees is formed on each coil 2 between one lead part 4 and the winding portion 22, and the lead parts 4, 5 differ in orientation from each other by 90 degrees.

Figure 3:
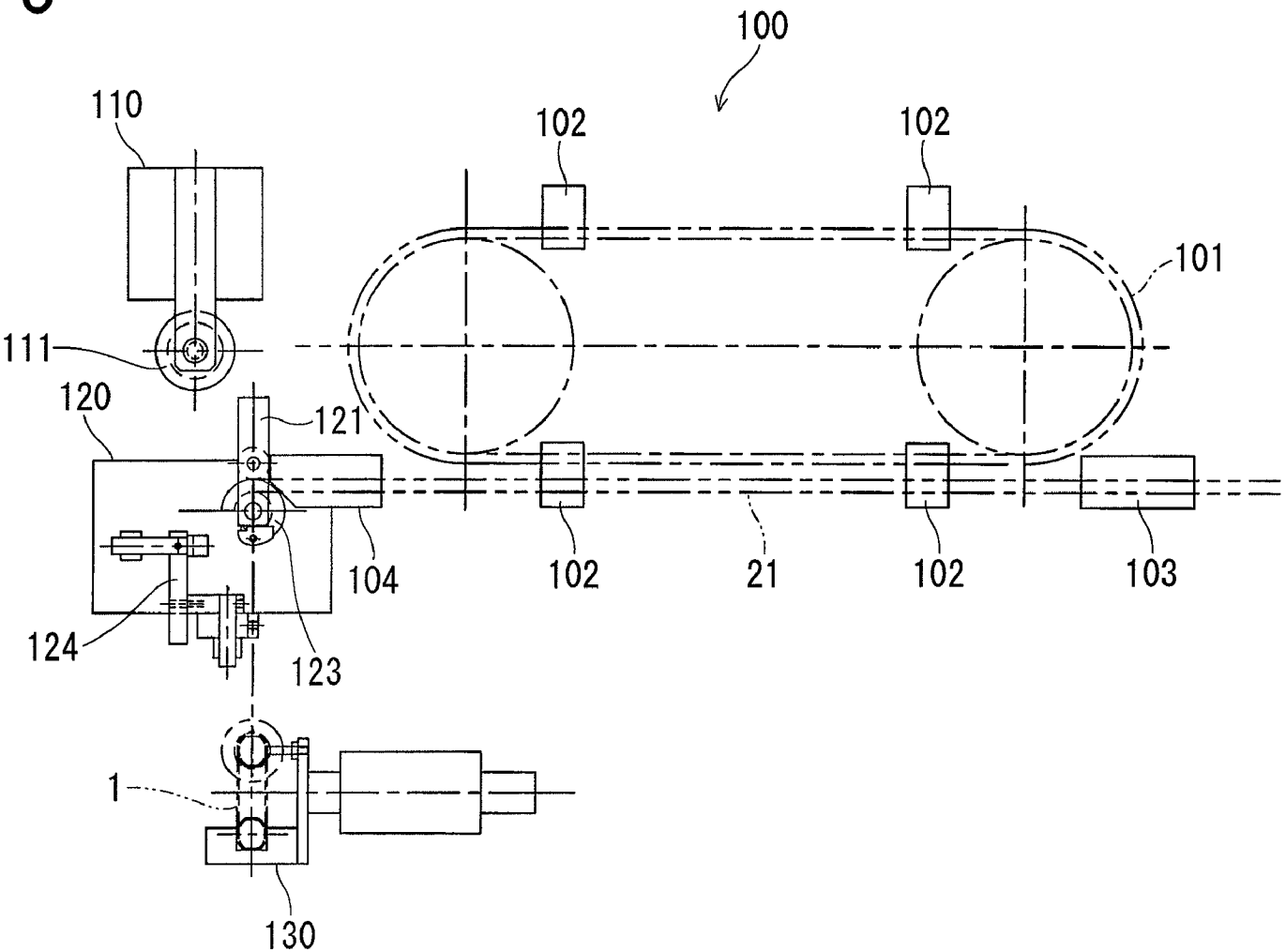
FIG. 3 is a front view showing a configuration of a manufacturing apparatus for manufacturing the coil device according to the present invention.

FIG. 3 shows a manufacturing apparatus of the coil device described above. This manufacturing apparatus comprises a conductive wire feeding device 100 for feeding the conductive wire 21, a tip end part forming device 120 for forming a tip end part of the conductive wire 21 fed from the conductive wire feeding device 100 into a predetermined shape, a core holding device 130 for holding the core 1 so that the core 1 can rotate around a central axis thereof, and a forming device 110 for bending and plastically deforming spirally the conductive wire 21 fed from the conductive wire feeding device 100 to wind it around the outer circumferential surface of the core 1.

The conductive wire feeding device 100 includes an inlet wire guide 103 and an outlet wire guide 104 through which the conductive wire 21 passes, a plurality of conductive wire chuck mechanisms 102 for gripping the conductive wire 21 extending between the wire guides 103, 104, and a drive mechanism 101 for driving these conductive wire chuck mechanisms 102 to move the conductive wire 21 in one direction.

Figure 4:
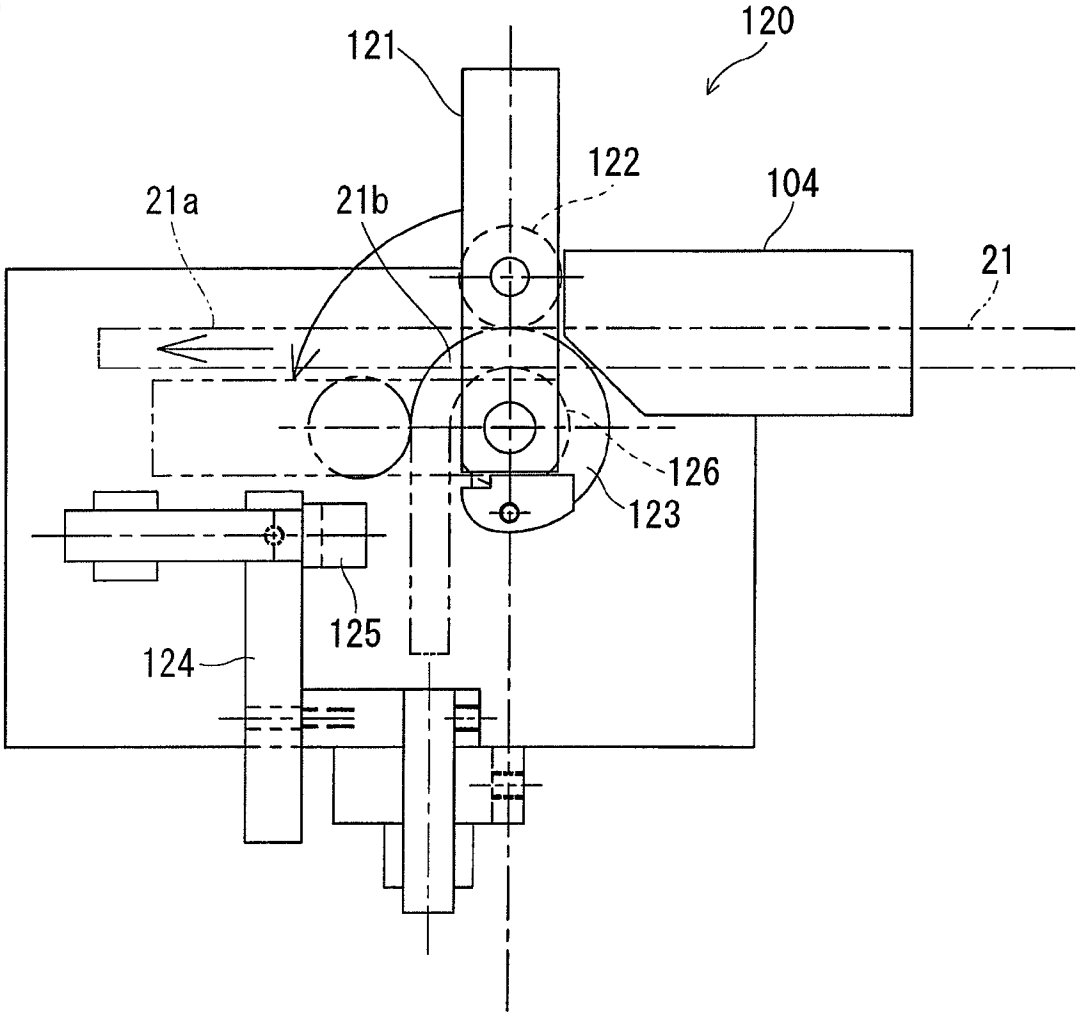
FIG. 4 is a view showing a step of bending a tip end part of a conductive wire with a tip end part forming device.

As shown in FIG. 4, the tip end part forming device 120 includes a jig 123 arranged on an outlet side of the outlet wire guide 104, and a rotating lever 121 including a roller 122 for bending the conductive wire 21 fed from the outlet wire guide 104 along an outer peripheral surface of the jig 123.

The jig 123 is provided with a groove 126 for accommodating the conductive wire 21. As shown in FIG. 4, by rotating the rotating lever 121 by about 90 degrees as indicated by an arrow counterclockwise with the tip end part of the conductive wire 21 which is fed from the outlet wire guide 104 by a predetermined amount engaged with the groove 126, the conductive wire 21 can be bent by about 90 degrees in a direction where the second moment of area is greater.

Figure 5:
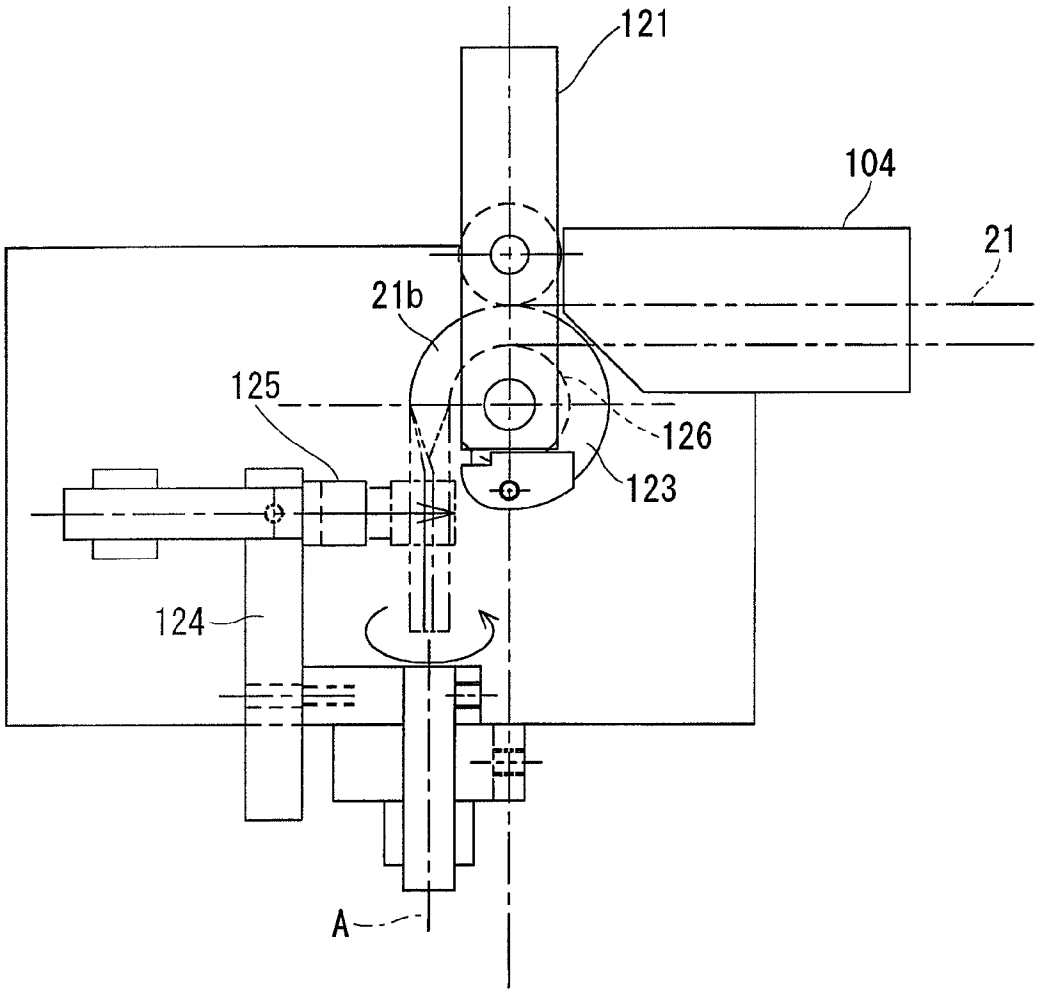
FIG. 5 is a view showing a step of twisting the tip end part of the conductive wire with the tip end part forming device.
Figure 6:
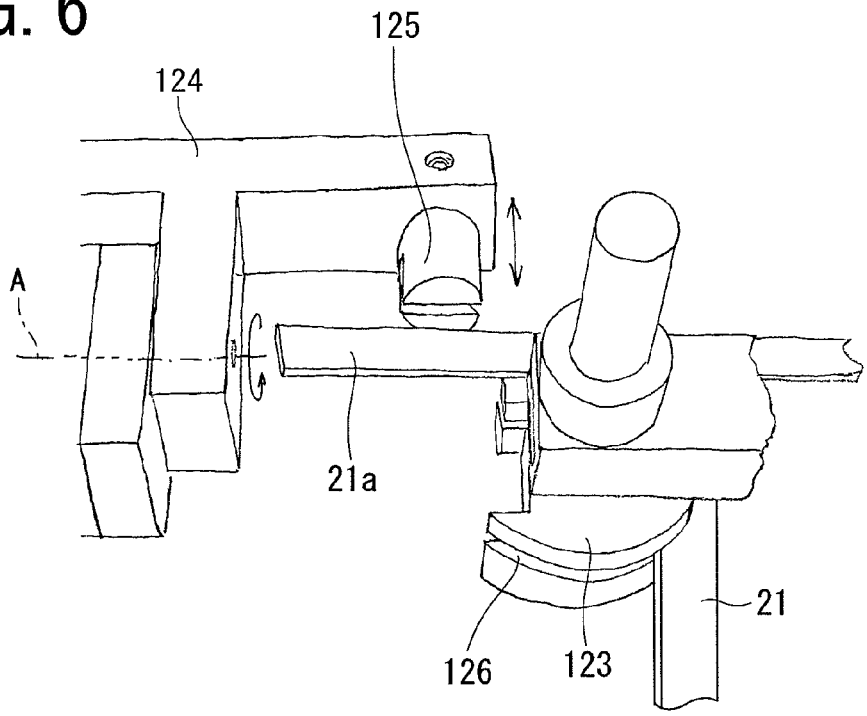
FIG. 6 is a perspective view showing a twist lever for twisting the tip end part of the conductive wire.
Figure 7:
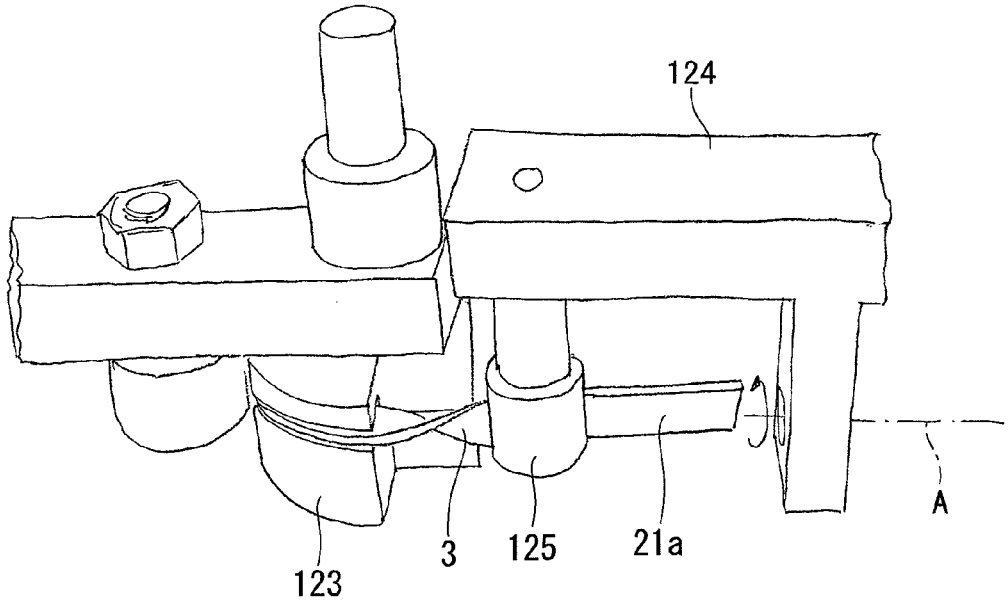
FIG. 7 is a perspective view showing a state where the tip end part of the conductive wire is twisted by the twist lever.

Also, the tip end part forming device 120 is provided with a twist lever 124 including a conductive wire clip 125 which can hold a tip end part 21*a* of the conductive wire 21 as shown in FIG. 6. By rotating the twist lever 124 by 90 degrees around an axis A as shown in FIG. 5 with the tip end part 21*a* of the conductive wire 21 held by the conductive wire clip 125, it is possible to twist the tip end part 21*a* of the conductive wire by 90 degrees with respect to a conductive wire portion arranged rearward continuously from the tip end part 21*a* as shown in FIG. 7 to form the twist part 3.

Figure 8:
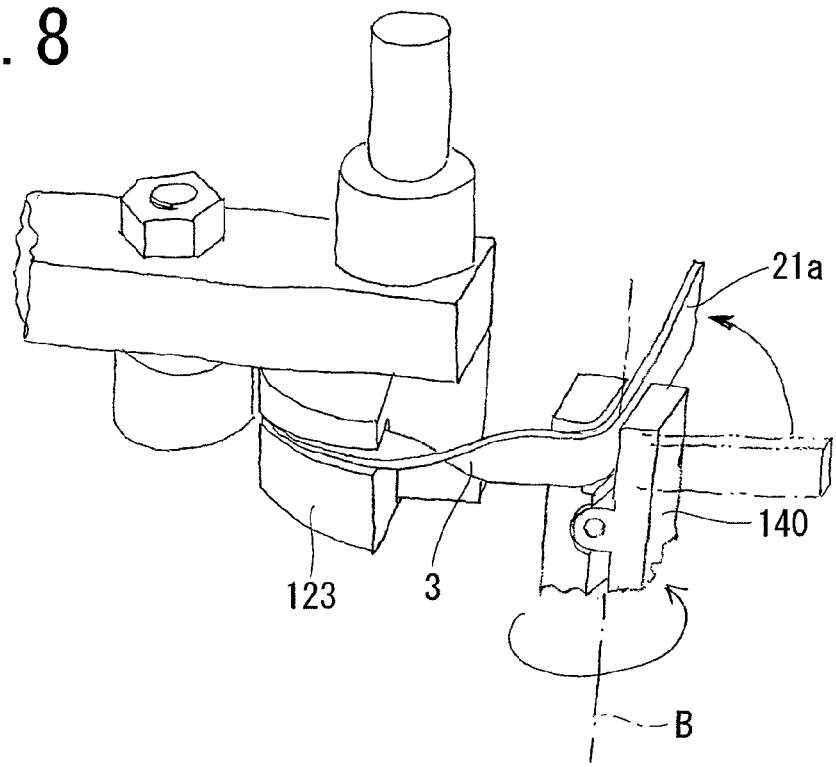
FIG. 8 is a perspective view showing a state where the tip end part of the conductive wire is bent by a conductive wire folding mechanism.
Figure 9:
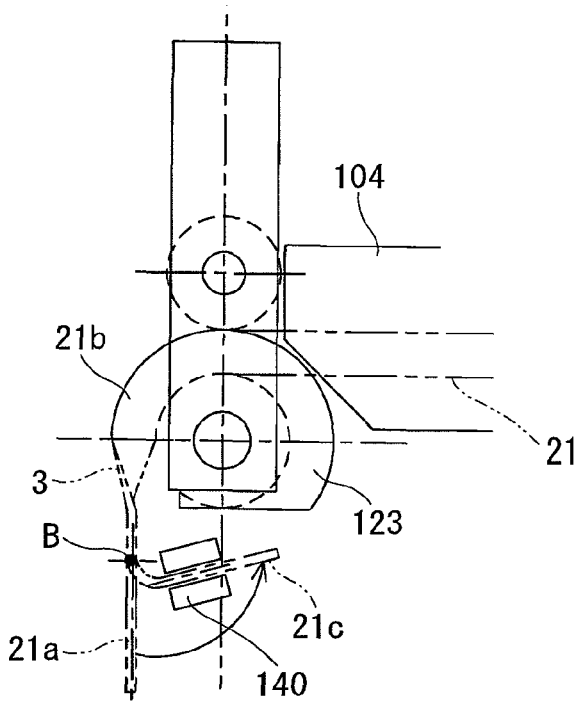
FIG. 9 is a front view showing a state where the tip end part of the conductive wire is bent by the conductive wire folding mechanism.

Further, a conductive wire folding mechanism 140 shown in FIG. 8 is arranged on a side of the twist lever 124. The conductive wire folding mechanism 140 can fold the tip end part 21*a* of the conductive wire at a halfway position in a direction where the second moment of area is smaller by rotating by 100 to 110 degrees around an axis B while holding the tip end part 21*a* of the conductive wire as shown in FIGS. 8 and 9.

Figure 10:
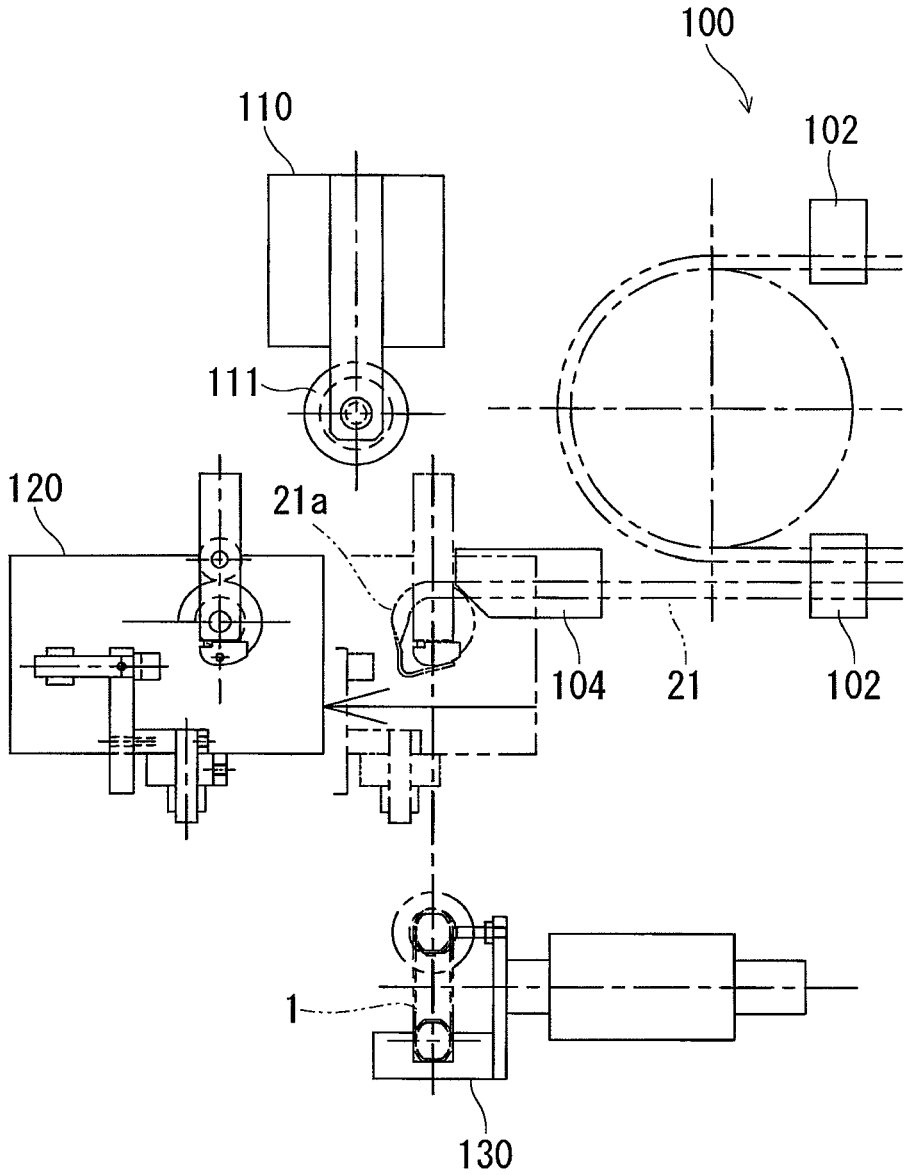
FIG. 10 is a view showing a first stage of a preparation step of the winding using the forming device.
Figure 23:
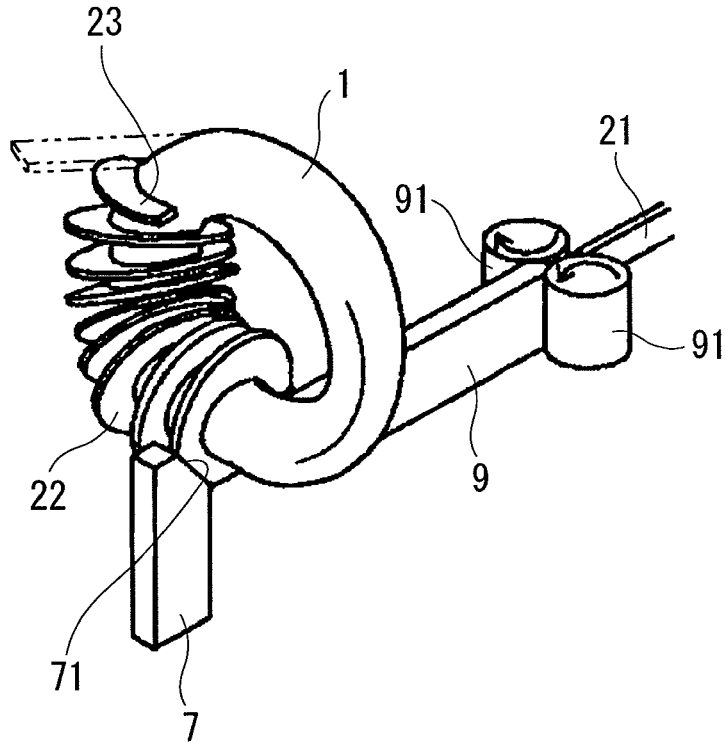
FIG. 23 PRIOR ART
FIG. 23 is a perspective view showing a manufacturing apparatuses of a conventional coil device.
Figure 24:
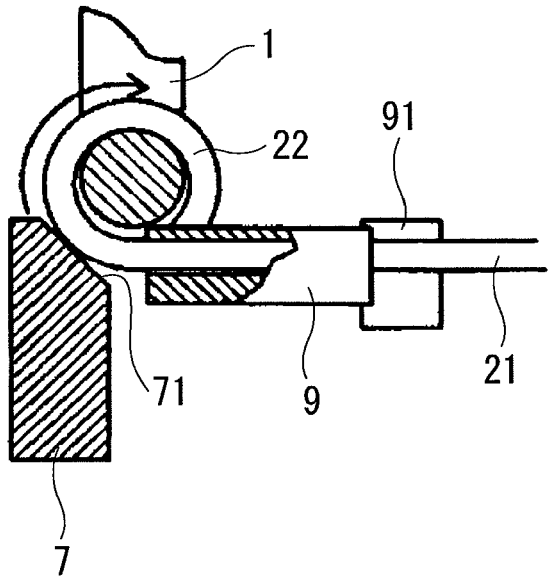
FIG. 24 PRIOR ART
FIG. 24 is a view showing a step of forming a winding portion of the coil with the conventional manufacturing apparatus.
Figure 25:
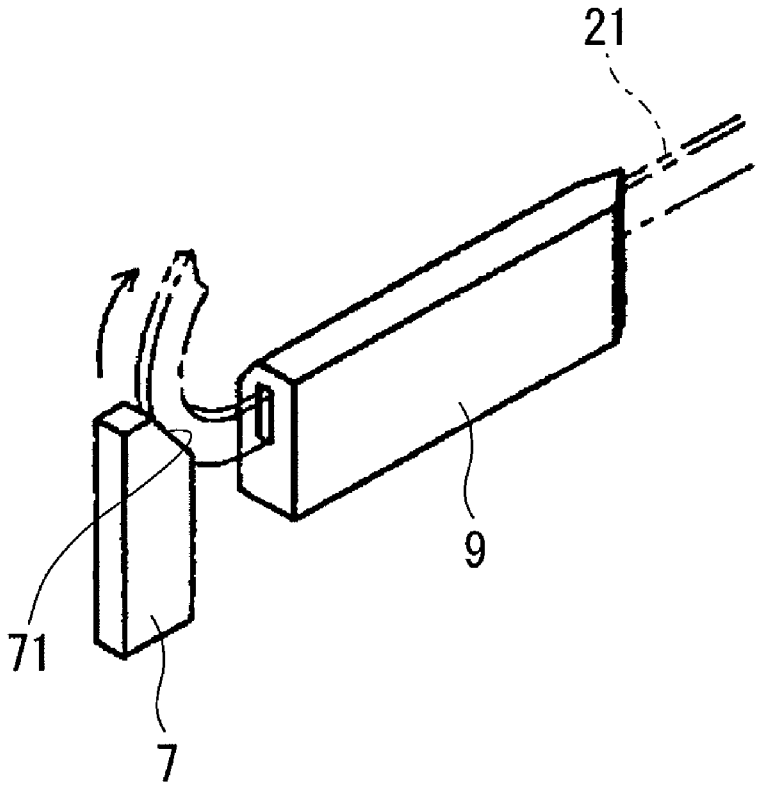
FIG. 25 PRIOR ART
FIG. 25 is a perspective view for explaining a function of a forming member.
Figure 26A:
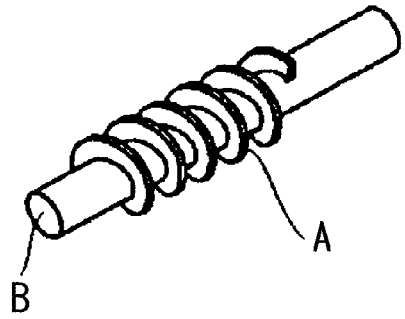
FIG. 26(a) PRIOR ART
FIG. 26 is a process drawing showing another conventional manufacturing method.
Figure 26B:
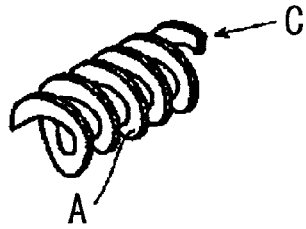
FIG. 26(b) PRIOR ART
Figure 26C:
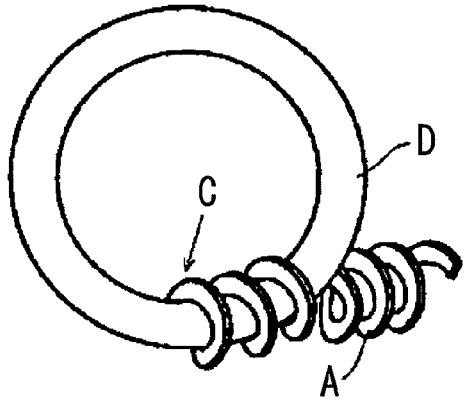
FIG. 26(c) PRIOR ART

As shown in FIG. 10, the forming device 110 includes a shaping roller 111. The shaping roller 111 corresponds to the conventional forming member 7 shown in FIGS. 23 and 24, and the conductive wire 21 is bent and wound around the outer peripheral surface of the core 1 by pressing the conductive wire 21 against the shaping roller 111.

Figure 14:
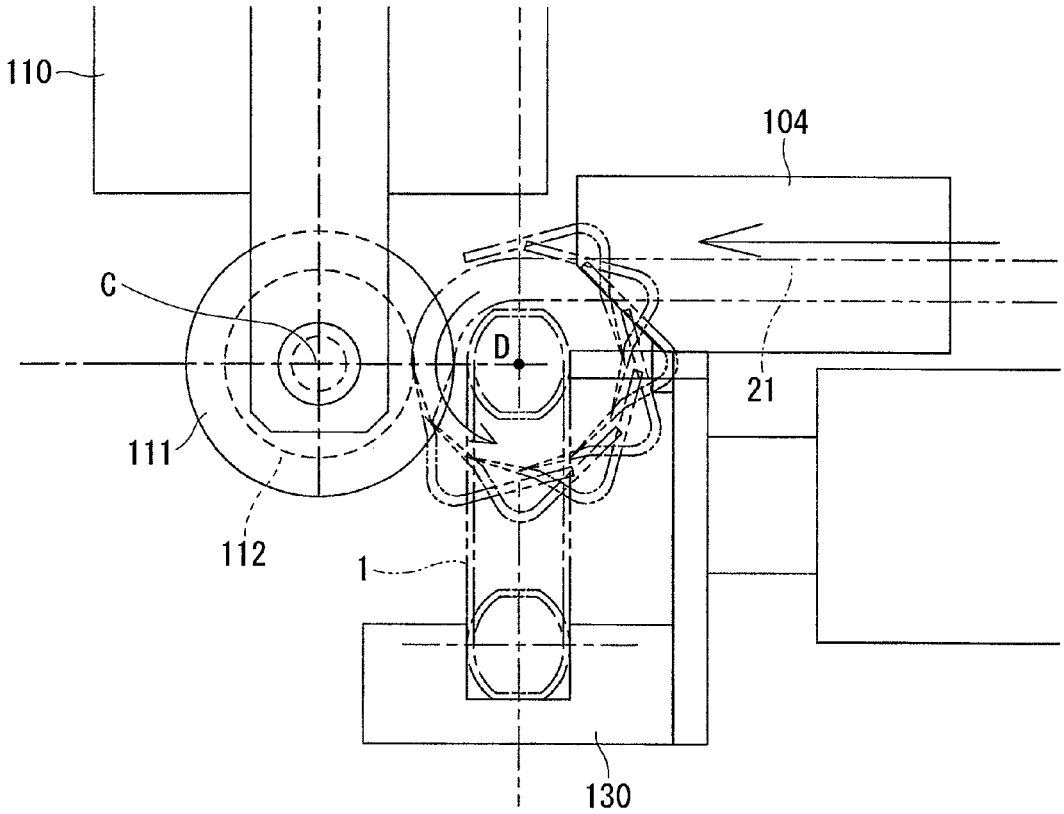
FIG. 14 is a view showing in an enlarged manner an essential part of a step of winding the conductive wire around the outer peripheral surface of the core.
Figure 15:
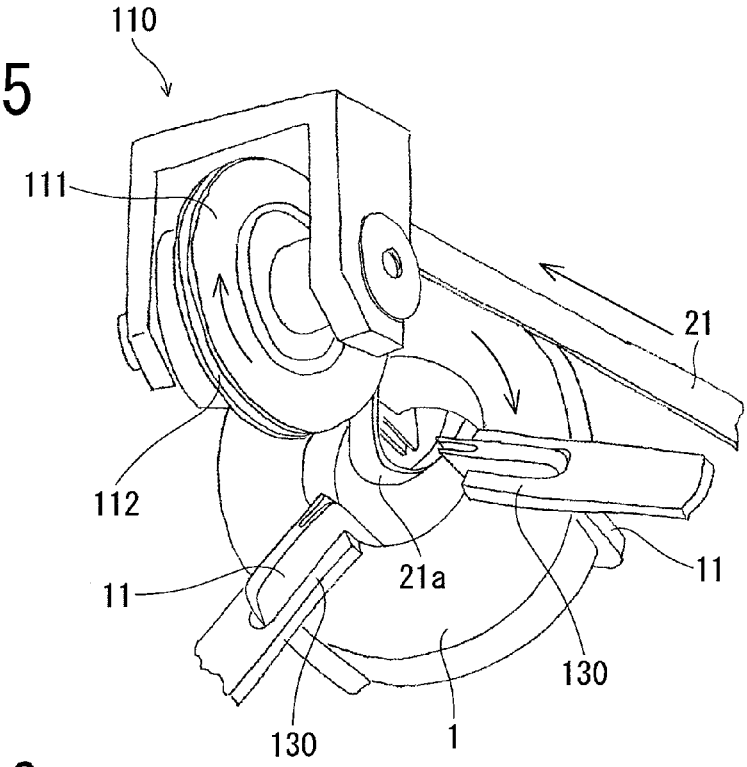
FIG. 15 is a perspective view showing an initial state of the step of winding the conductive wire around the outer peripheral surface of the core.
Figure 16:
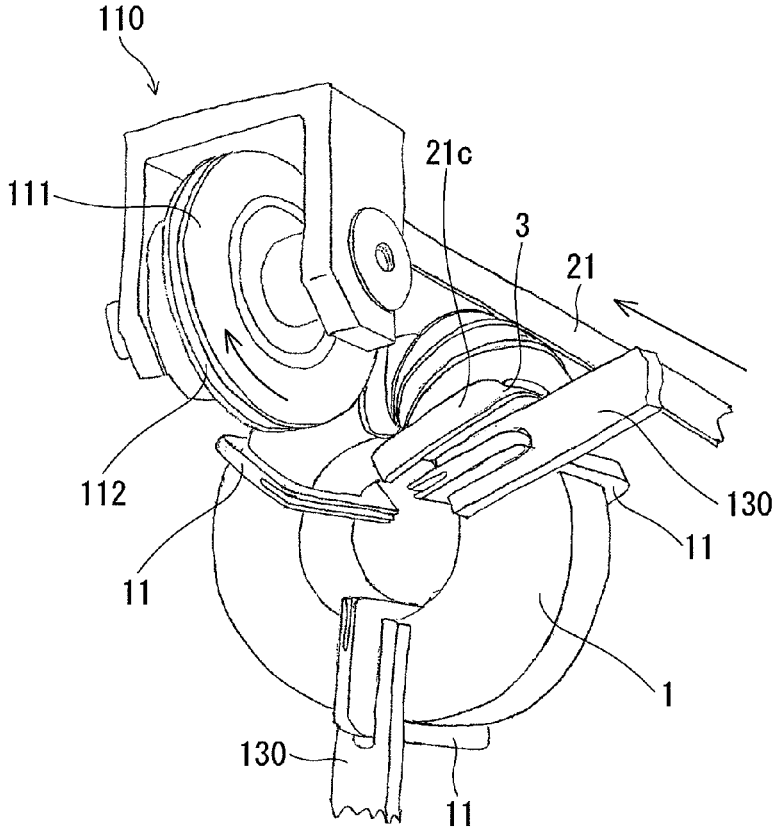
FIG. 16 is a perspective view showing a halfway state of the step of winding the conductive wire around the outer peripheral surface of the core.

As shown in FIGS. 15 and 16, the shaping roller 111 includes an outer peripheral surface provided with a groove 112 which can accommodate the conductive wire 21, and a bottom face of the groove 112 forms a forming surface (cf. FIG. 14).

In the manufacture of the coil device using the manufacturing apparatus described above, first, in a state where a certain amount of the conductive wire 21 is paid out from the outlet wire guide 104 as shown in FIG. 4, the tip end part 21*a* of the conductive wire 21 is put between the jig 123 and the roller 122 of the tip end part forming device 120, and then, the rotating lever 121 is rotated by about 90 degrees counterclockwise as indicated by an arrow. The tip end part 21*a* of the conductive wire 21 is thereby bent by about 90 degrees in a direction where the second moment of area is greater to form a bent part 21*b*.

Then as shown in FIG. 5, the rotating lever 121 is returned to an original position and the conductive wire clip 125 is advanced. And then, as shown in FIGS. 6 and 7, the tip end part 21*a* of the conductive wire 21 is held by the conductive wire clip 125 and the twist lever 124 is rotated by 90 degrees around the axis A shown in FIG. 7. The tip end part 21*a* of the conductive wire is thereby twisted by 90 degrees with respect to the conductive wire portion arranged rearward continuously from the tip end part 21*a* to form the twist part 3.

Subsequently, as shown in FIGS. 8 and 9, by rotating the conductive wire folding mechanism 140 which is gripping the tip end part 21*a* of the conductive wire by 100 to 110 degrees around the axis B, the tip end part 21*a* of the conductive wire is folded at a halfway position in a direction where the second moment of area is smaller. Thereby, on the tip end part 21*a* of the conductive wire 21, a folded part 21*c* is formed on the tip end side with respect to the twist part 3.

It is also possible to form the folded part 21*c* by rotating the conductive wire clip 125 around the axis B shown in FIG. 8 with the tip end part 21*a* of the conductive wire still gripped by the conductive wire clip 125, after the twist part 3 is formed on the tip end part 21*a* of the conductive wire by the conductive wire clip 125 of the twist lever 124.

Thereafter, as shown in FIG. 10, the tip end part forming device 120 is retreated. The tip end part forming device 120 thereby leaves the tip end part 21*a* of the conductive wire 21.

Also, the core 1 is placed in the core holding device 130. As shown in FIG. 15, each rib 11 of the core 1 is thereby held by the core holding device 130.

Figure 11:
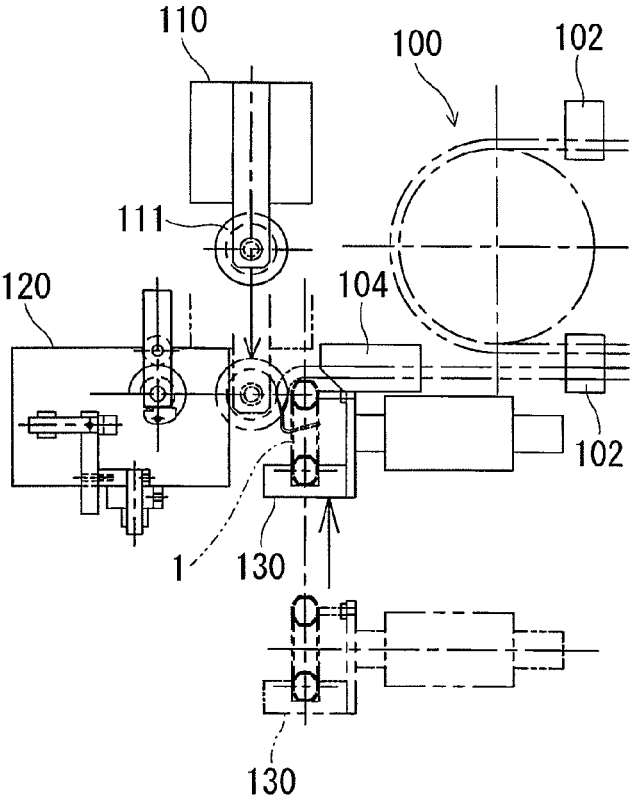
FIG. 11 is a view showing a second stage of the preparation step of the winding using the forming device.
Figure 12:
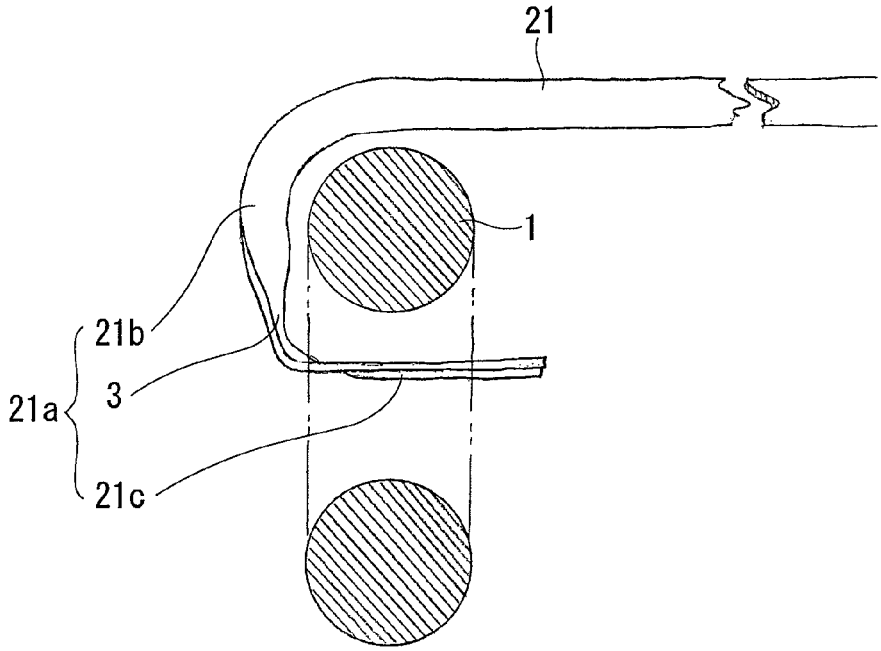
FIG. 12 is a partially broken front view showing a state where the tip end part of the conductive wire is hooked on an outer peripheral surface of a core.

Then, as shown in FIG. 11, the core holding device 130 is advanced to a winding position, and the tip end part 21*a* of the conductive wire 21 is hooked on the outer peripheral surface of the core 1 as shown FIG. 12. The bent part 21*b* forming the tip end part 21*a* of the conductive wire 21 is thereby wound along the outer peripheral surface of the core 1 from an outside of the core 1 in an angular range of about 90 degrees, and the twist part 3 is further arranged along the outer peripheral surface of the core 1. The folded part 21*c* extending from the twist part 3 to the tip end side passes through a central aperture of the core 1, and the tip end part 21*a* including the bent part 21*b*, the twist part 3, and the folded part 21*c* is wound around the outer peripheral surface of the core 1 over a range of approximately 180 degrees.

Figure 13:
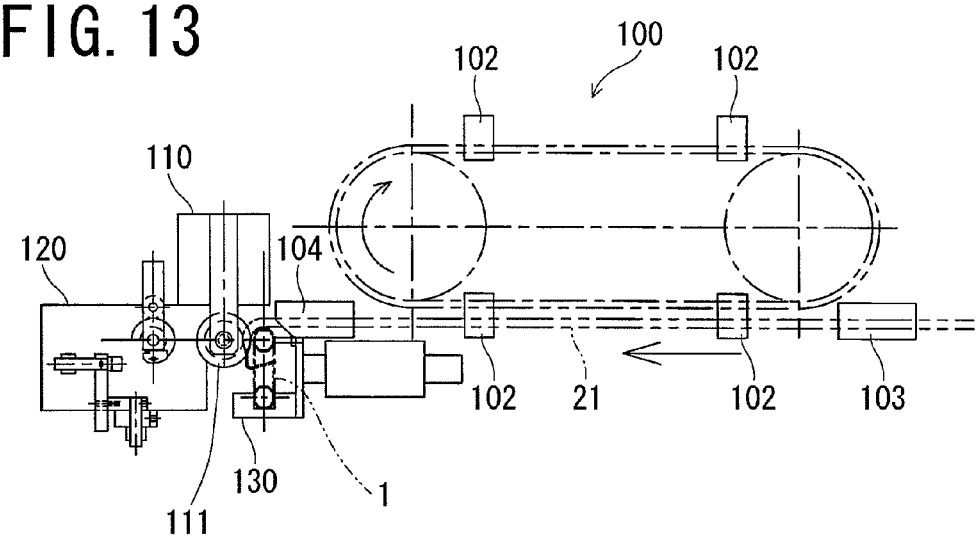
FIG. 13 is a view showing an initial state of a step of feeding the conductive wire from a conductive wire feeding device and winding the conductive wire around the outer peripheral surface of the core.

Thereafter, the forming device 110 is advanced to the winding position as shown in FIG. 13. As shown in FIG. 14, a rotation center C of the shaping roller 111 is thereby substantially flush with a cross-sectional center D of the core 1 at a height position. Also, the bent part 21*b* of the conductive wire 21 shown in FIG. 12 is accommodated in the groove 112 of the shaping roller 111.

In this state, as shown in FIG. 13, the conductive wire feeding device 100 is activated, the conductive wire 21 is fed from the conductive wire feeding device 100 at a constant speed, and the core 1 is rotated around the central axis thereof at a constant speed by the core holding device 130.

The conductive wire 21 fed by the outlet wire guide 104 as shown in FIG. 14 is thereby pressed against the outer peripheral surface of the shaping roller 111 (a bottom face of the groove 112) to be bent, and is wound around the outer peripheral surface of the core 1.

FIG. 15 shows a state where the tip end part 21*a* of the conductive wire 21 is hooked on the outer peripheral surface of the core 1. When the conductive wire 21 is fed toward the shaping roller 111 from this state, and the core 1 is rotated clockwise, the conductive wire 21 is wound around the outer peripheral surface of the core 1 as shown in FIG. 16 spirally. In this process, since the twist part 3 and the bent part 21*b* of the conductive wire 21 are arranged along the outer peripheral surface of the core 1, they rotate around the core 1 without interfering with the outer peripheral surface of the core 1 as shown in FIG. 14.

When the conductive wire 21 is wound around the outer peripheral surface of the core 1 predetermined times and the winding portion with a predetermined number of windings is formed, feeding of the conductive wire 21 and rotation of the core 1 are stopped, and the conductive wire 21 arranged rearward continuously from the winding portion is cut at a predetermined position.

Figure 17:
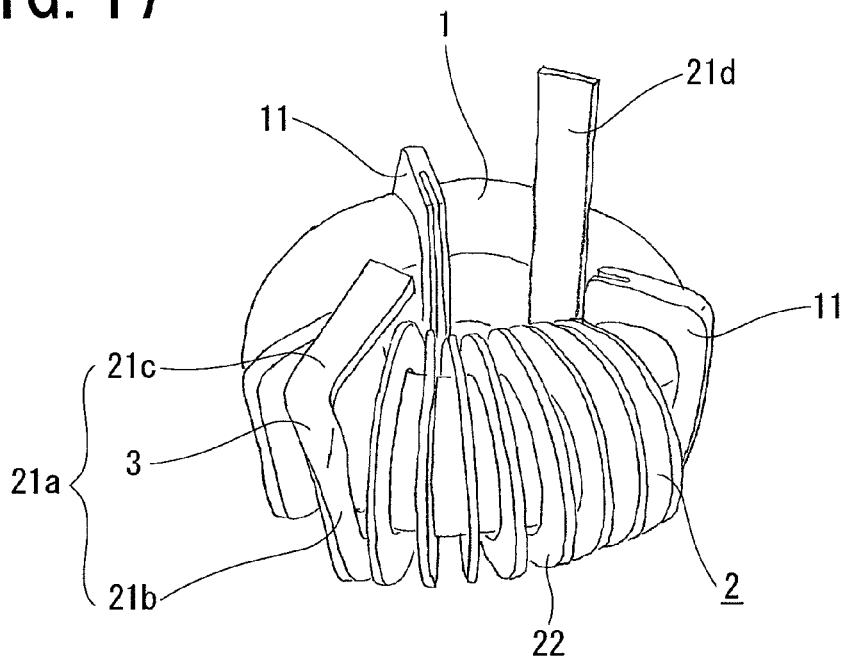
FIG. 17 is a perspective view showing a form of the coil when the step of winding the conductive wire around the outer peripheral surface of the core is completed.

The winding portion 22 forming the coil 2 is thereby formed on the core 1 as shown in FIG. 17, and the tip end part 21*a* and a distal end part 21*d* projecting from both ends of the winding portion 22 are formed. Here, the tip end part 21*a* comprises the bent part 21*b*, the twist part 3, and the folded part 21*c*, and is wound around the outer peripheral surface of the core 1.

Subsequently, the same winding step is also implemented in other two winding areas of the core 1, so that three coils 2, 2, 2 are wound around the core 1.

Figure 18:
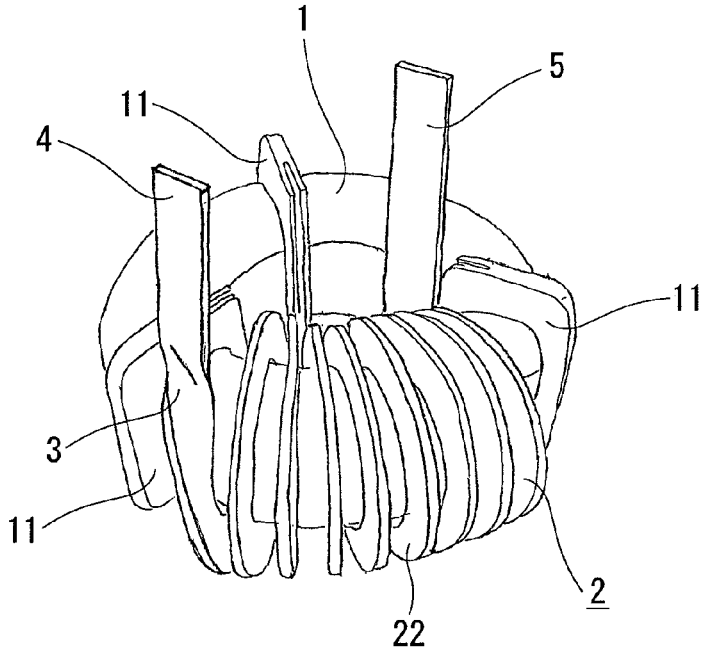
FIG. 18 is a perspective view showing a form of the coil when a pair of lead parts is formed on a coil.

Finally, shape of the tip end part 21*a* of each coil 2 shown in FIG. 17 is corrected so that a direction of the folded part 21*c* becomes parallel to the distal end part 21*d*. As shown in FIG. 18, the one lead part 4 is thereby formed on the tip end side with respect to the twist part 3, and the other lead part 5 is formed by the distal end part 21*d*.

As a result, the coil device shown in FIG. 1 is completed.

According to the manufacturing method of the coil device described above, as shown in FIGS. 17 and 18, in a step of forming the tip end part 21*a* into substantially a linear shape by deforming plastically the folded part 21*c* of the conductive wire wound around the outer peripheral surface of the core 1 in a direction apart from the outer peripheral surface of the core 1, since the folded part 21*c* is wound around the outer peripheral surface of the core 1 in a lying posture on the outer peripheral surface, the smaller second moment of area of the conductive wire participates in the transformation of the folded part 21*c*. Therefore, a great force is not necessary to transform the conductive wire in the direction apart from the outer peripheral surface of the core 1, and the lead part 4 is formed extremely easily.

The present invention is not limited to the foregoing embodiment in construction but can be modified variously within the technical range set forth in the appended claims.

For example, the step of winding the tip end part of the conductive wire 21 around the outer peripheral surface of the core 1 can be implemented before forming the twist part 3 as well as after forming the twist part 3. In such a case, after winding the tip end part of the conductive wire 21 around the outer peripheral surface of the core 1 in a lying posture on the peripheral surface, the conductive wire 21 arranged rearward continuously from the tip end part is twisted by 90 degrees or approximately 90 degrees with respect to the tip end part to form the twist part 3 on the conductive wire 21.

Also, instead of a step of bending the tip end part 21*a* of the conductive wire by the conductive wire folding mechanism 140 shown in FIGS. 8 and 9, it is possible to employ a step of bending the tip end part 21*a* of the conductive wire in a shape of an arc at a curvature at which the tip end part 21*a* of the conductive wire follows the outer peripheral surface of the core 1.

Figure 19A:
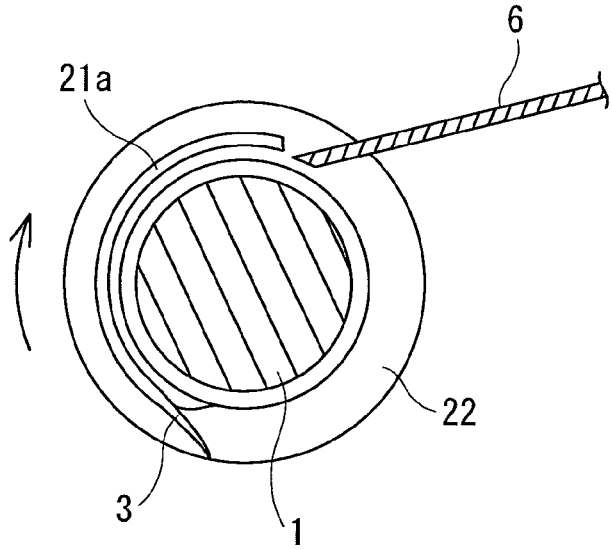
FIG. 19 is a view showing a step of transforming the tip end part of the conductive wire wound around the outer peripheral surface of the core in a direction apart from the core using a spatula.
Figure 19B:
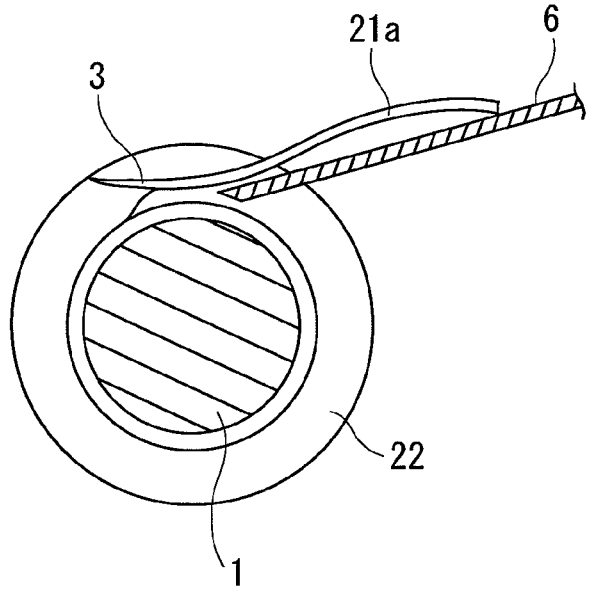

In such a case, by performing the winding step to form the winding portion 22, the tip end part 21*a* of the conductive wire is wound along the outer peripheral surface of the core 1 as shown in FIG. 19(*a*). In the step of forming the tip end part 21*a* of the conductive wire into the substantially linear lead part 4, as shown in FIGS. 19(*a*) and 19(*b*) for example, by inserting a spatula 6 between the tip end part 21*a* wound around the outer peripheral surface of the core 1 and the outer peripheral surface of the core 1, and rotating the core 1 in a direction of an arrow, it is possible to separate the tip end part 21*a* from the outer peripheral surface of the core and transform the tip end part 21*a* into a substantially linear shape.

Figure 20:
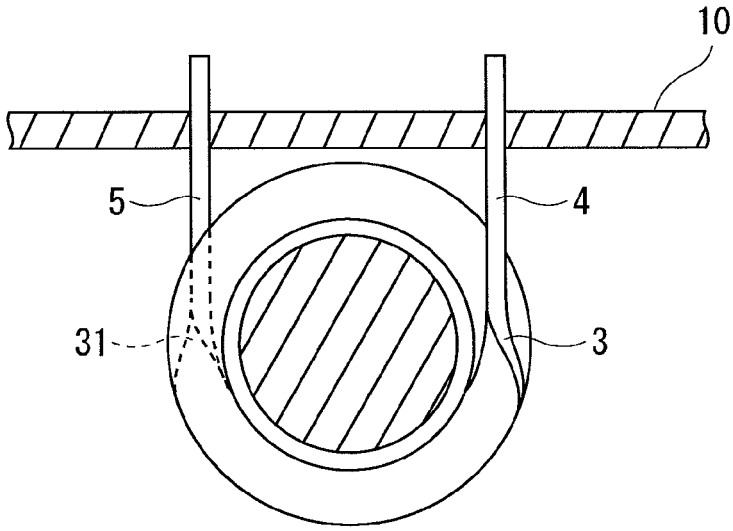
FIG. 20 is a cross-sectional view showing another configuration example of the coil device according to the present invention.
Figure 21:
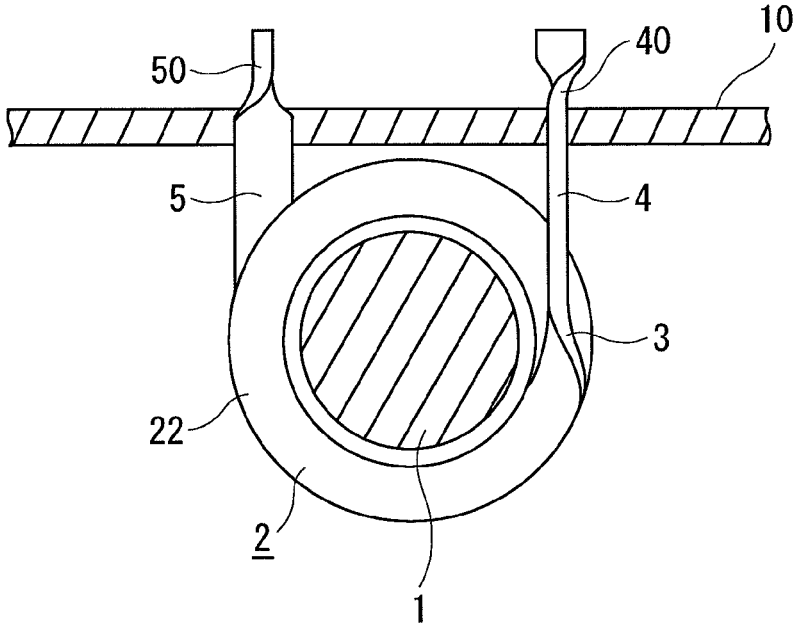
FIG. 21 is a cross-sectional view showing a further configuration example of the coil device according to the present invention.

Also, as shown in FIG. 20, by forming a twist part 31 on the other lead part 5 as well as on the one lead part 4, both the lead parts 4, 5 can have the same direction. Further, if necessary, it is also possible to form twist parts 40, 50 on tip end parts of the pair of lead parts 4, 5 projecting from the substrate 10 as shown in FIG. 21.

As the conductive wire 21 forming the coil 2, it is possible to employ various conductive wires 21 with various cross-sectional shapes such as a trapezoid line having a trapezoidal cross-section as shown in FIG. 22(*b*), an oval line having an oval cross-section as shown in FIG. 22(*c*) and the like.

What is claimed is:

1. A method for manufacturing a coil device comprising a ring-like core with a coil wound therearound, the coil including a winding portion formed by a conductive wire wound around the core, and a pair of lead parts formed by the conductive wire projecting from both ends of the winding portion, the conductive wire having a cross-sectional shape with a height dimension greater than a width dimension, and the conductive wire which forms the winding portion being aligned in a widthwise direction of the conductive wire along an outer peripheral surface of the core and repeatedly wound, comprising;

a first step of twisting a tip end part of the conductive wire by 90 degrees or approximately 90 degrees with respect to a conductive wire portion arranged rearward continuously from the tip end part to form a twist part, and bending the tip end part of the conductive wire in a direction where the second moment of area is smaller and winding the conductive wire around an outer periphery surface of the core;

a second step of bending the conductive wire arranged rearward continuously from the twist part in a direction where the second moment of area is greater and winding the conductive wire around the outer periphery surface of the core to form the winding portion; and a third step of transforming the conductive wire on a tip end side with respect to the twist part in a direction apart from the outer periphery surface of the core to form one lead part extending substantially linearly, and forming the other lead part by the conductive wire arranged rearward continuously from the winding portion.

2. The method for manufacturing the coil device according to claim 1, wherein the first step comprises:

a twist part forming step of twisting the tip end part of the conductive wire by 90 degrees or approximately 90 degrees with respect to the conductive wire arranged rearward continuously from the tip end part to form the twist part on the conductive wire; and a conductive wire winding step of thereafter winding the conductive wire on the tip end side with respect to the twist part around the outer periphery surface of the core in a lying posture on the outer peripheral surface.

3. The method for manufacturing the coil device according to claim 2, wherein in the twist part forming step, the tip end part of the conductive wire is bent in such a direction and at such a curvature that the tip end part can be wound in a standing posture on the outer peripheral surface of the core, thereafter the twist part is formed on the tip end side of a bent portion, and in the conductive wire winding step, the conductive wire on the tip end side with respect to the twist part is placed so as to follow the outer peripheral surface of the core.

4. The method for manufacturing the coil device according to claim 3, wherein in the twist part forming step, after forming the twist part on the tip end part of the conductive wire, the conductive wire on the tip end side with respect to the twist part is bent in such a direction that the conductive wire follows the outer peripheral surface of the core.

5. The method for manufacturing the coil device according to claim 1, wherein the first step comprises:

a conductive wire winding step of winding the tip end part of the conductive wire around the outer peripheral surface of the core in a lying posture on the outer peripheral surface; and a conductive wire twisting step of thereafter twisting the conductive wire arranged rearward continuously from the tip end part by 90 degrees or approximately 90 degrees with respect to the tip end part to form the twist part on the conductive wire.

6. The method for manufacturing the coil device according to claim 1, wherein the conductive wire has a cross-sectional shape with different second moments of area in directions perpendicular to each other, in the first step, the conductive wire on the tip end side with respect to the twist part is bent in a direction where the second moment of area is smaller to be wound around the outer peripheral surface of the core, and in the second step, the conductive wire arranged rearward continuously from the twist part is bent in a direction where the second moment of area is greater to be wound around the outer peripheral surface of the core.

7. The method for manufacturing the coil device according to claim 1, wherein in the second step, the-conductive wire is fed toward a forming member, the core placed on a plane crossing a direction in which the conductive wire is fed is rotated around a central axis of the core, and the conductive wire is pressed against a forming surface of the forming member, to bend the conductive wire and wind the conductive wire around the outer peripheral surface of the core.

* * * * *